US005177835A

United States Patent [19]

Ogawa et al.

[11] Patent Number: 5,177,835

[45] Date of Patent: Jan. 12, 1993

[54] METHOD AND APPARATUS FOR PIECING SLIVERS

[75] Inventors: Yuhei Ogawa, Gifu; Shinzo Nishimura, Bisai, both of Japan

[73] Assignee: Howa Machinery, Ltd., Aichi, Japan

[21] Appl. No.: 778,271

[22] Filed: Oct. 17, 1991

[30] Foreign Application Priority Data

Oct. 19, 1990 [JP] Japan ..... 2-280595

[51] Int. Cl.[5] ..... D01H 5/74

[52] U.S. Cl. ..... 19/260; 19/271; 19/150; 19/152

[58] Field of Search ..... 19/51, 150, 152, 157, 19/144, 236, 243, 258, 260, 271, 287, 293, 294; 28/103, 141

[56] References Cited

U.S. PATENT DOCUMENTS

| | | | |
|---|---|---|---|
| 2,608,725 | 9/1952 | Strew | 19/157 |
| 3,315,321 | 4/1967 | Kobayashi et al. | 19/157 |
| 4,419,791 | 12/1983 | Schär | 19/236 |
| 4,987,645 | 1/1991 | Kawasaki et al. | 19/150 |
| 5,058,241 | 10/1991 | Haigh et al. | 19/150 |

FOREIGN PATENT DOCUMENTS

| | | | |
|---|---|---|---|
| 41-2739 | 2/1966 | Japan | 19/157 |
| 42-14134 | 8/1967 | Japan | 19/157 |

*Primary Examiner*—Werner H. Schroeder
*Assistant Examiner*—Michael A. Neas
*Attorney, Agent, or Firm*—Stevens, Davis, Miller & Mosher

[57] ABSTRACT

First and second slivers (6, 5) are pieced together by the following steps: overlapping a trailing portion (6a) of a first sliver and a leading portion (5a) of a second sliver; introducing the overlapped portion (5a, 6a) into a drafting zone provided between a pair of lower and upper back rollers (11, 12) and a pair of lower and upper front rollers (13, 14) arranged along a sliver path from upstream to downstream; maintaining the peripheral speeds of the back and front rollers (11, 12; 13, 14) at the same speed, so that no draft is imparted to the overlapped portion until a leading end of the overlapped portion has reached the nip zone of the front rollers (13, 14); increasing only the peripheral speed of the front rollers (13, 14) to impart a predetermined draft to the overlapped portion until a trailing end thereof has passed through a nip zone of the back rollers (11, 12), whereby a thickness of the overlapped portion becomes substantially equal to the original proper sliver thickness; laterally rubbing the drafted overlapped portion by a pair of rubbing rollers (16, 17) so that fibers therein are entangled with each other to form a connection with a sufficient mechanical strength able to withstand a force imposed during subsequent spinning processes.

8 Claims, 8 Drawing Sheets

METHOD AND APPARATUS FOR PIECING SLIVERS

BACKGROUND OF THE INVENTION

1. Field of the Invention

The present invention relates to a method and apparatus for automatically piecing slivers in a spinning process using a roving frame or a drawing frame.

2. Description of the Related Arts

In general, a sliver piecing operation is carried out by hand, i.e., one sliver end is overlapped with another sliver end by a length measured by eye, and the overlapped ends are pressed between the palms and rubbed together. This manual operation, however, requires considerable skill, and even an expert cannot always ensure that the pieced portion of the slivers has a sufficient mechanical strength and a uniform thickness, and thus the pieced portion is often broken or irregularly drafted in the subsequent spinning process, to thereby deteriorate the quality of the resultant yarn.

To solve the above problems, an apparatus for mechanically piecing sliver ends is proposed in Japanese Examined Patent Publication No. 38-5867. In this apparatus, each of the old and the fresh slivers to be pieced is nipped by two pairs of rollers spaced from each other by a predetermined length, one pair of rollers is moved away from the other so that the nipped sliver is severed and a tapered end with fiber tuft is obtained, and a trailing portion of the old sliver and a leading portion of the fresh sliver are overlapped with each other so that one fiber tuft is complemented by the other fiber tuft to thereby form a proper sliver thickness. Then the overlapped portion is pierced by needles, which then are moved laterally to widen the width thereof, and after the needless are removed, the overlapped fiber tufts are rubbed together, to be intermingled with each other by the axial reciprocation of top and bottom rollers of a group of nip rolls, in opposite directions.

In the prior art sliver piecing, a length of the fiber tuft forming the sliver end to be overlapped is defined by a mean staple length, due to the formation thereof, and is limited to at most twice a mean staple length. Also, since needles are used for enhancing the entanglement of fibers in the overlapped portion and widening the width thereof, the fibers are liable to be bent and the parallelism thereof lost. Under such circumstances, even though the top and bottom rollers of the nip rolls are reciprocated in opposite directions to each other, while nipping the overlapped portion therebetween, the fibers in the overlapped portion cannot be sufficiently entangled so that the overlapped portion is given a mechanical strength that can withstand the following spinning processes.

SUMMARY OF THE INVENTION

Accordingly, an object of the present invention is to solve the above drawbacks of the prior art, by a method of providing an improved connection between two slivers to be pieced, and an apparatus suitable for carrying out this method.

This object is achieved, according to the present invention, by a method of piecing first and second slivers and comprising the steps of: overlapping a trailing portion of a first sliver and a leading portion of a second sliver; introducing the overlapped portion into a drafting zone provided between a pair of upper and lower back rollers and a pair of upper and lower front rollers arranged along a sliver path, from upstream to downstream thereof; maintaining the peripheral speeds of the back and front rollers at an equal value so that a draft is not imparted to the overlapped portion until a leading end of the overlapped portion has reached the nip zone of the front rollers; thereafter, changing the relative peripheral speed between the back and front rollers to impart a predetermined draft to the overlapped portion, until a trailing end thereof has passed through a nip zone of the back rollers, whereby a thickness of the overlapped portion becomes substantially equal to the original proper sliver thickness; laterally rubbing the drafted overlapped portion sequentially delivered downstream from the draft zone so that fibers therein are entangled with each other, to thereby form a connection having a sufficient mechanical strength able to withstand the forces imposed during the subsequent spinning process.

Preferably the rubbing step is carried out by sequentially introducing the drafted overlapped portion into a nip zone of upper and lower rubbing rollers arranged downstream of the front rollers, the upper and lower rubbing rollers being axially reciprocated in opposite directions while nipping the sliver therebetween.

Alternatively, the rubbing step may be carried out by axially reciprocating the upper and lower front rollers in opposite directions while nipping the sliver therebetween.

According to one aspect of the present invention, an apparatus for piecing first and second slivers is provided and comprises: a roller stand stationarily mounted on a machine frame; a group of a lower feed roller, a lower back roller, a lower front roller and a lower rubbing roller, each arranged on the roller stand from upstream to downstream of a sliver path; a top arm member movable up and down and arranged above the roller stand; a group of an upper feed roller, an upper back roller, an upper front roller and an upper rubbing roller, each arranged on the top arm member from upstream to downstream of the sliver path; the upper rollers being brought into contact with the corresponding lower rollers on the roller stand and driven thereby, when the top arm member is lowered; a common main motor for driving the lower back and front rollers and the lower rubbing roller; a sub-motor for driving only the lower feed roller; means for changing a draft ratio between the lower back and front rollers; means for axially reciprocating the lower and upper rubbing rollers in opposite directions, whereby a sliver nipped by the lower and upper rubbing rollers is rubbed together; and a controller for controlling the operations of the respective elements constituting the apparatus; whereby a trailing portion of the first sliver and a leading portion of the second sliver are overlapped with each other while being nipped between the lower rollers and the upper rollers, and the overlapped portion is drafted and then rubbed together to form a uniform and reinforced connection therebetween.

According to another aspect of the present invention, an apparatus for piecing first and second slivers is provided and comprises: a first roller stand stationarily mounted on a machine frame; a group of a lower back roller, a lower front roller and a lower rubbing roller, each arranged on the first roller stand from upstream to downstream of a sliver path; a first top arm member movable up and down and arranged above the roller stand; a group of an upper back roller, an upper front roller and an upper rubbing roller, each arranged on the top arm member from upstream to downstream of the sliver path; the upper rollers being brought into contact with the corresponding lower rollers on the first roller stand and driven thereby, when the first top arm member is lowered; a common main motor for driving the lower back and front rollers and the lower rubbing roller; a second roller stand arranged upstream of the first roller stand, and horizontally displaceable away from and toward first roller stand; a lower feed roller arranged on the second roller stand; a second top arm member movable up and down and arranged above the second roller stand, and horizontally displaceable away from and toward the first top arm member; an upper feed roller arranged on the second top arm member and brought into contact with the lower feed roller and driven thereby, when the second top arm member is lowered; means for horizontally displacing the second roller stand away from and toward the first roller stand; a sub-motor for driving only the lower feed roller in the normal/reverse direction, and movable together with the second roller stand by the means for displacing the second roller stand; means for changing a draft ratio between the lower back and front rollers; means for axially reciprocating the lower and upper rubbing rollers in opposite directions so that a sliver nipped by the lower and upper rubbing rollers is rubbed together; means for introducing a trailing portion of the first sliver above the lower rollers supported on the first roller stand while the first top arm member is lifted; means for introducing a leading portion of the second sliver above the lower feed roller supported on the second roller stand while the second top arm member is lifted; means for detecting a leading end of the second sliver in the nip zone of the feed rollers and generating a signal for changing a rotational direction of the sub-motor; a controller for controlling the operations of the respective elements constituting the apparatus; whereby a trailing portion of the first sliver and a leading portion of the second sliver are overlapped with each other while being nipped between the lower rollers and the upper rollers, and the overlapped portion is drafted and then rubbed together to form a uniform and reinforced connection therebetween.

BRIEF DESCRIPTION OF THE DRAWINGS

The other and further objects of the present invention will be apparent from the following description with reference to the preferred embodiments illustrated in the attached drawings; in which.

DESCRIPTION OF THE PREFERRED EMBODIMENTS

Figure 1:
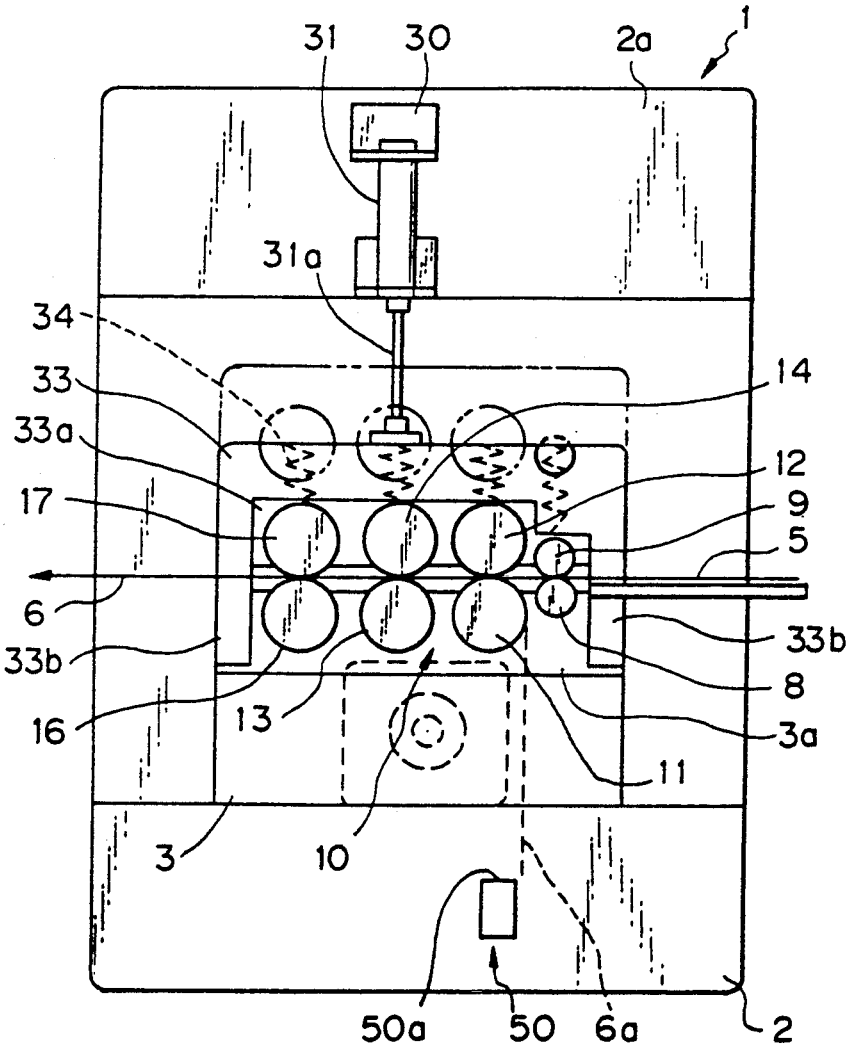
FIG. 1 is a diagrammatic side view of a sliver piecing apparatus according to the present invention, illustrating a nipped state of old and fresh slivers.
Figure 2:
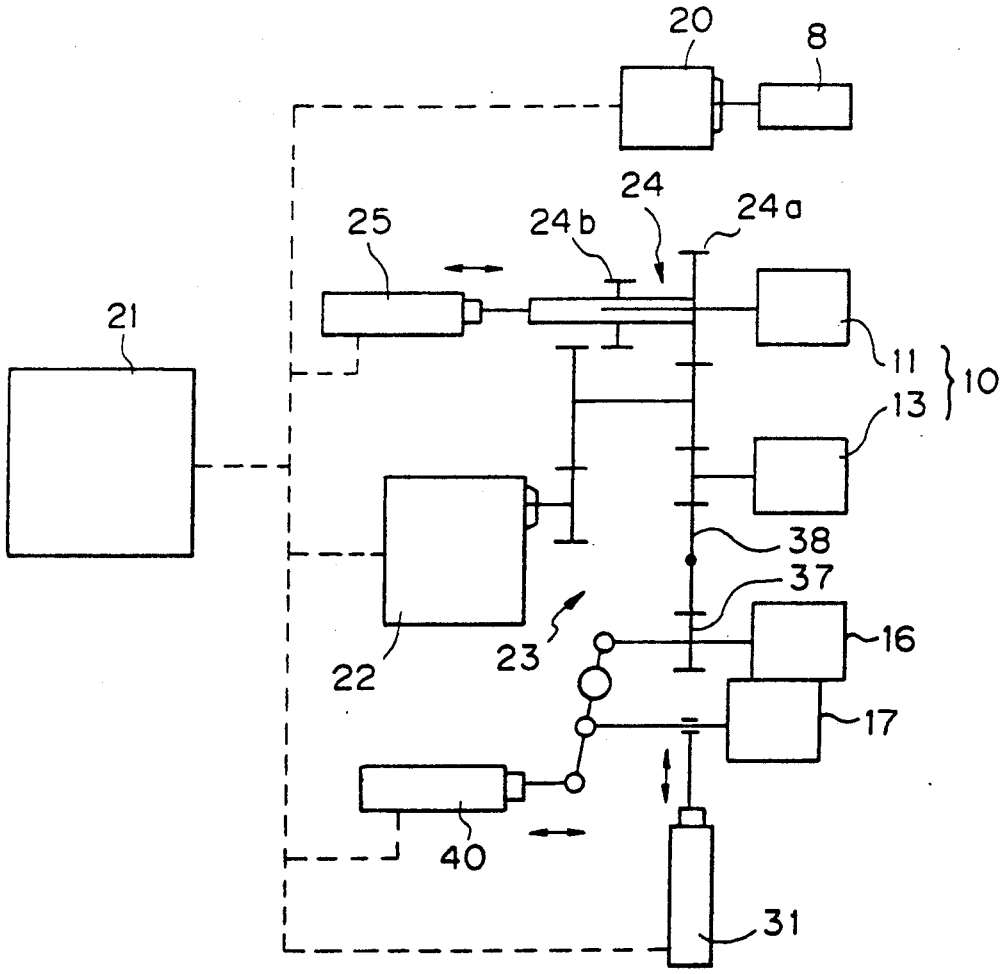
FIG. 2 is a system for driving and controlling a draft roller mechanism and a rubbing roller mechanism of the sliver piecing apparatus.

In FIGS. 1 and 2, a sliver piecing apparatus 1 according to the present invention has a base frame 2 on which are arranged a pair of lower and upper feed rollers 8, 9, a pair of lower and upper back rollers 11, 12, a pair of lower and upper front rollers 13, 14, and a pair of lower and upper rubbing rollers 16, 17. The pair of back rollers 11, 12 and the pair of front rollers 13, 14 constitute a drafting mechanism 10. In the illustrated embodiment, all of the rollers, except for the feed rollers 8, 9, have the same diameter.

The lower feed roller 8 is rotatably held on a roller stand 3 by a bearing 3*a* and exclusively driven by a motor 20 connected to a shaft end, the rotating speed being controlled by a signal output by a controller 21, as shown in FIG. 2.

Similarly, the lower back roller 11 and the lower front roller 13 are rotatably held by the bearings 3*a* and driven by a common main motor 22 via a gear train 23 including a draft wheel set 24, and are controlled by a signal output by the controller 21. The draft wheel set 24 is fitted to a shaft of the lower back roller 11 by, for example, a spline connection, and thus is slidable along the axis of the roller shaft while be rotated therewith. The draft wheel set 24 consists of a large and small wheels 24*a*, 24*b* for changing a rotational speed of the lower back roller 11. The draft wheel set 24 is displaced in the axial direction by a draft-changing power cylinder 25 connected thereto by a piston rod. The power cylinder 25 is operated by a signal from the controller 21 to shift the draft wheel set 24 to selectively intermesh one of wheels 24*a*, 24*b* with the mating wheel in the gear train 23. In the embodiment illustrated in FIG. 2, the number of teeth of the respective wheels is such that, as shown in the drawing, when the large wheel 24*a* is intermeshed, the lower back roller 11 is rotated at half a speed of the lower front roller 13, and conversely, when the small intermeshed, the lower back and front rollers 11, 13 are rotated at the same speed.

A top arm up and down movable power cylinder 31 is suspended from a bracket 30 fixed on an upper side wall 2*a* of the base frame 2, and a top arm member 33 is mounted at a tip end of a piston rod 31*a* thereof directed downward. The top arm member 33 is provided with the upper feed roller 9, the upper back roller 12 and the upper front roller 14, rotatably held by a bearing 33*a*. Springs 34 are provided between the bearings 33*a* and the top arm member 33 for biasing the upper rollers 9, 12 and 14 downward toward the lower rollers 8, 11 and 13, respectively. The top arm member 33 also has a pair of guide plates 33*b* and 33*c* on the opposite sides thereof, for sandwiching the roller stand 3 to prevent a rotation of the top arm member 33 during the up and down movement thereof.

Figure 3:
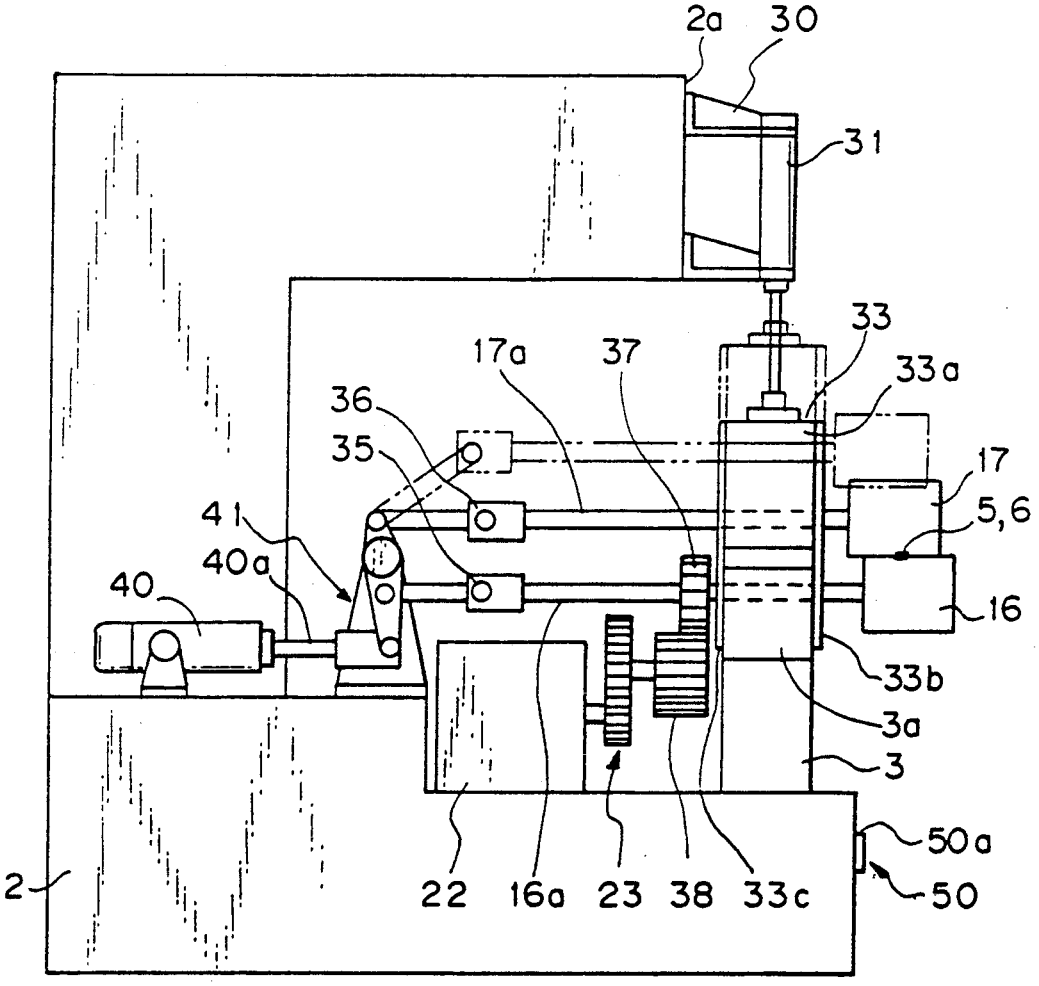
FIG. 3 is a diagrammatic side view of the sliver piecing apparatus according to the present invention, illustrating an operation of the rubbing roller mechanism.
Figure 4A:
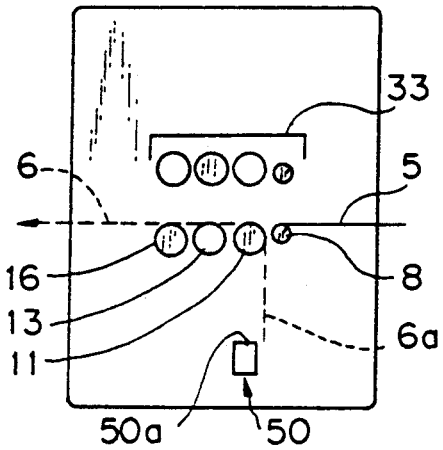
FIGS. 4(*a*) through 4(*d*) are schematic views sequentially illustrating steps of a basic sliver piecing operation according to the present invention.
Figure 4B:
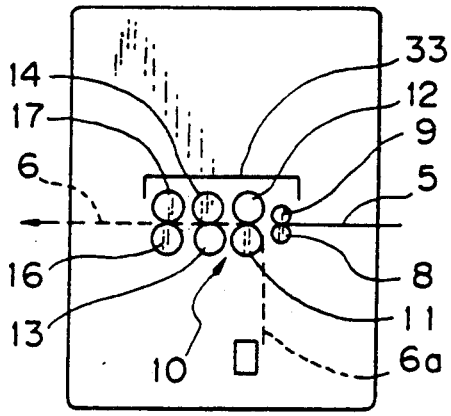
Figure 4C:
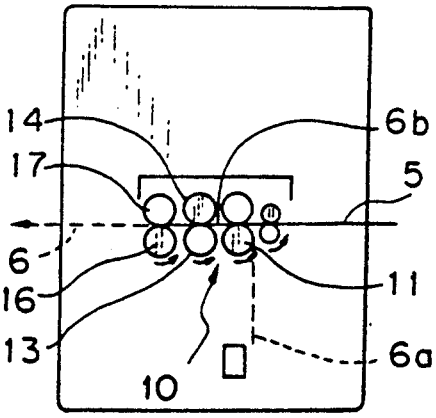
Figure 4D:
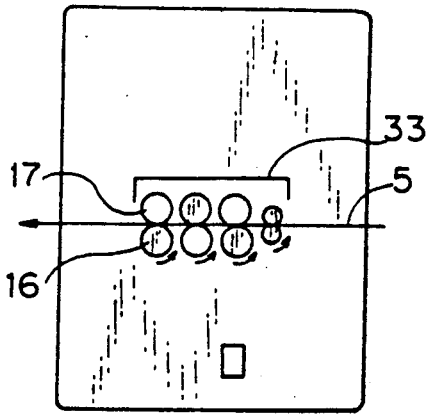

As shown in FIG. 3, the lower and upper rubbing rollers 16, 17 are rotatably and axially slidably held by the bearings 33*a* and 3*a*, respectively. Shafts 16*a* and 17*a* of the lower and upper rubbing rollers 16 and 17 are protruded for a predetermined distance toward the main motor 22, and couplings 35, 36 are secured to the outer ends of the shafts 16*a*, 17*a*, respectively, and connect the latter to a link mechanism 41. The link mechanism 41 is pivoted at the tip end of a piston rod 40*a* of a rubbing action power cylinder 40 and drives the shafts 16*a*, 17*a* to cause an axial movement thereof in opposite directions, so that a reciprocating rubbing action is generated between the lower and upper rubbing rollers 16, 17 by a repeated operation of the power cylinder 40. A wheel 37 fixed to the shaft 16*a* of the lower rubbing roller 16 is intermeshed with a mating wheel 38 in the gear train 23, having a wider tooth width, and accordingly, the intermeshing thereof is maintained even when the lower rubbing roller 16 is axially displaced to the extremity thereof during the rubbing operation, and thus the rotation of the main motor 22 is always transmitted to the lower rubbing roller 16. The surfaces of the rubbing rollers 16, 17 to be brought into contact with a sliver are preferably covered with a material suitable for gripping the sliver, such as a rubber or polyurethane resin. The other rollers also may have such a structure.

On the side wall of the base frame 2, a marking plate 50 is fixed at a position just beneath the lower back roller 11, for determining a suitable length of an old sliver 6 to be used for the sliver piecing operation by hanging a trailing end of the old sliver 6 down from the lower back roller 11 to a top edge 50*a* of the marking plate 50.

The controller 21 has the following functions:

controlling the start and stop of the main motor 22 commonly driving the lower back roller 11, the lower front roller 13, and the lower rubbing roller 16;

controlling the rotation of the motor 20 exclusively driving the feed rollers, to synchronize the rotational speed of the lower feed roller 8 with that of the lower back roller 11;

controlling a timing of the operation of the top arm up and down power cylinder 31 for lifting and lowering the top arm member 33;

controlling a timing of the operation of the draft change power cylinder 25 for selecting the wheel 24*a* or 24*b* of the draft wheel set 24; and controlling a timing of the operation of the rubbing action power cylinder 40 for causing a rubbing action between the lower and upper rubbing rollers 16, 17.

A sliver piecing operation using the apparatus described above will be explained below:

When the top arm member 33 occupies an upper position shown by a chain line in FIG. 1, an old sliver 6 is placed on the lower back roller 11, the lower front roller 13 and the lower rubbing roller 16, and the trailing end portion 6*a* projected from the lower back roller 11 is hung down to the upper edge 50*a* of the marking plate 50. Then a fresh sliver 5 is placed on the lower feed roller 8, and thus a waiting position shown in FIG. 4(*a*) is obtained.

The power cylinder 31 is actuated by a start signal from the controller 21 to project the piston rod 31*a* downward so that the top arm member 33 secured at the tip end thereof is lowered, and accordingly the upper rollers 9, 12, 14 and 17 supported by the top arm member 33 are pressed onto the mating lower rollers 8, 11, 13 and 16 to nip the fresh and old slivers 5, 6 therebetween, as shown in FIG. 4(*b*). Then the motor 20 for the feed roller and the main motor 22 are simultaneously started, to rotate the lower rollers 8, 11, 13 and 16, whereby the old sliver 6 is forwarded and a leading portion of the fresh sliver 5 is delivered between the lower and upper back rollers 11, 12, and thus, as shown in FIG. 4(*c*), the leading portion of the fresh sliver 5 is gradually overlapped with the trailing portion 6*a* of the old sliver 6. At this stage, as the small wheel 24*b* is first selected from the draft wheel set 24 by the action of the power cylinder 25 actuated by a signal from the controller 21, the rotational speed of the lower back roller 11 is equal to that of the lower front roller 13, and thus no draft is imparted to the trailing portion 6*a* of the old sliver nipped between the back roller pair 11, 12 and the front roller pair 13, 14.

At an instant forecast by a timer, at which a leading end of the overlapped portion of the fresh and old slivers 5 and 6 has reached the nip zone of the front roller pair 13, 14, the power cylinder 25 is actuated to select the large wheel 24*a* so that the overlapped portion of the fresh and old slivers 5, 6 is doubly drafted to a proper sliver thickness. The drafted sliver portion is sequentially delivered to a nip zone of the rubbing roller pair 16, 17. Then the rubbing rollers 16, 17 repeat, while rotating about their own axis, an axial reciprocation in opposite directions by a predetermined signal from the controller 21, so that the fibers in the overlapped portion of the slivers are entangled with each other to form a strengthened connection therebetween.

When the trailing end of the overlapped portion has just passed through the nip zone of the back roller pair 11, 12, the draft wheel set 24 is again switched to select the small wheel 24*b* so that the rotational speed of the lower back roller 11 is equal to that of the lower front roller 13, and thus the fresh sliver 5 following the overlapped portion is forwarded without being drafted, as shown in FIG. 4(*d*). When the trailing end of the overlapped portion has just passed through the nip zone of the rubbing roller pair 16, 17, the motors 20 and 22 are stopped and the top arm member 33 is lifted, to release the fresh sliver 5 from the nip of the respective rollers.

A modification of the above embodiment of the sliver piecing apparatus will be described below.

In the above case, an old sliver 6 and a fresh sliver 5 are overlapped with each other, and after being drafted between back and front roller pairs 11, 12 and 13, 14, the overlapped portion is rubbed by a pair of rubbing rollers 16, 17 to cause fibers therein to be entangled with each other to thus form a strengthened connection therebetween. According to this modification, the structure is simplified by eliminating the front rollers 13, 14 and assigning the functions thereof to the rubbing rollers 16, 17.

Namely, in a drive system shown in FIG. 2, instead of removing the front rollers 13, 14, a pair of rubbing rollers 16' and 17' are arranged. Further, the number of teeth of the large wheel 24*a* is such that the lower rubbing roller 16' is made to rotate at a speed 1.6 times that of the lower back roller 11. The main motor 22 is a reversible motor and is controlled by the controller 21 to be sequentially rotatable in the normal direction, in the reverse direction and again in the normal direction, by predetermined signals from the controller 21. The rubbing action power cylinder 40 is reciprocatedly actuated only during the second normal rotation of the main motor 22, so that the lower and upper rubbing rollers 16' and 17' are axially reciprocated in opposite directions. During the reverse rotation of the main motor 22, the draft wheel set 24 is switched to select the small wheel 24*b*, so that the lower back roller 11 is made to rotate at a speed equal to that of the lower rubbing roller 16'.

In the sliver piecing operation according to this modification, a leading end of the fresh sliver 5 is nipped by the feed roller pair 8, 9, and the old sliver 6 is nipped by the back roller pair 11, 12 and the rubbing roller pair 16', 17' while a trailing portion of the old sliver 6 is hung down from the lower back roller 11 by a predetermined length. Then only the main motor 22 is made to normally rotate, to forward the trailing portion of the old sliver 6 while imparting a 1.6 times draft thereto in the draft zone between the back roller pair 11, 12 and the rubbing rollers 16', 17', and thus a thickness of the old sliver 6 is reduced to 62.5% of the original thickness. The main motor 22 is stopped when the trailing end of the old sliver 6 has been nipped by the back roller pair 11, 12. This state is shown in FIG. 5(*a*).

The draft wheel set 24 is switched to select the small wheel 24*b*, and the main motor 22 is reversed to displace the old sliver 6 backward until the leading end of the drafted portion thereof has reached the nip zone of the back roller pair 11, 12. According to this operation, the drafted portion 6*c* of the old sliver 6 hangs down from the lower back roller 11, and an excess thereof is then removed to match the upper edge 50*a* of the marking plate 50 as stated before. This state is shown in FIG. 5(*b*).

Figure 5A:
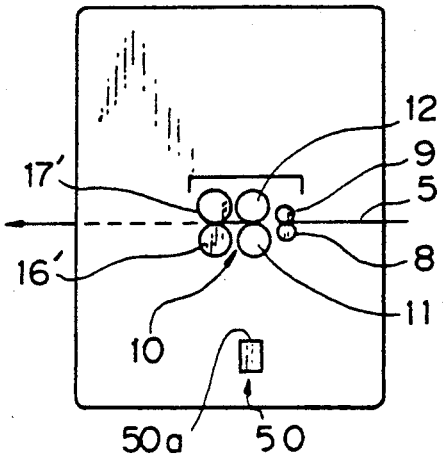
FIGS. 5(*a*) through 5(*c*) are schematic views sequentially illustrating steps of a modified sliver piecing operation according to the present invention.
Figure 5B:
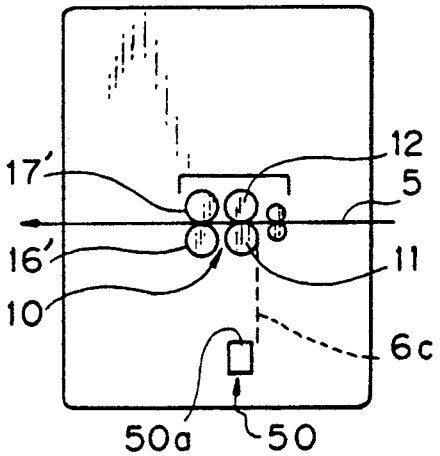
Figure 5C:
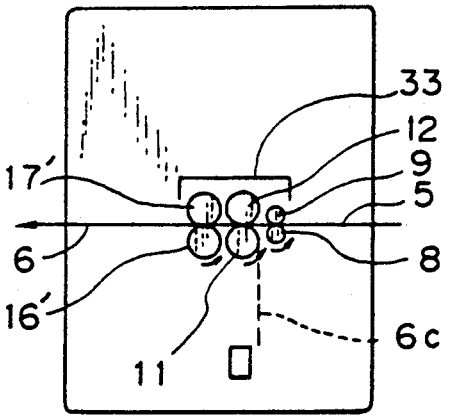

The draft wheel set 24 is again switched to select the large wheel 24*a* and the motors 20 and 22 are started, as shown in FIG. 5(*c*). The fresh sliver 5 nipped by the feed roller pair 8, 9 is forwarded to the back roller pair 11, 12 to form an overlapped portion with the drafted trailing portion 6*c* of the old sliver 6 while synchronized with the forward displacement thereof, and accordingly, a thickness of the overlapped portion becomes 162.5% of the original sliver thickness. The overlapped portion is again drafted 1.6 times between the back roller pair 11, 12 and the rubbing roller pair 16', 17', while being transversely rubbed by the rubbing roller pairs 16, and 17', whereby a connection with a thickness substantially equal to the original sliver thickness is obtained.

Figure 6:
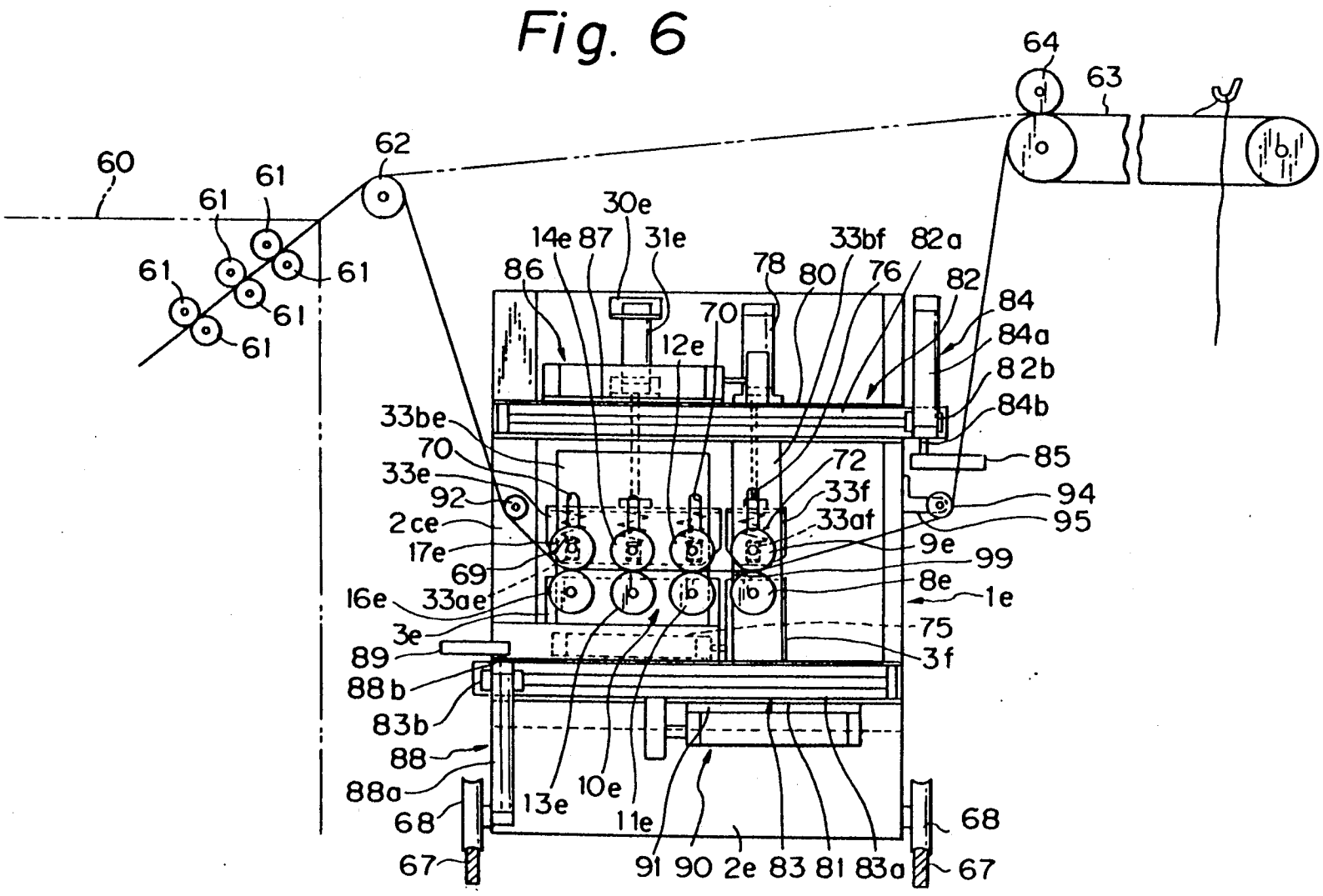
FIG. 6 is a diagrammatic side elevational view of a sliver piecing apparatus according to the present invention when applied to a roving frame.
Figure 7:
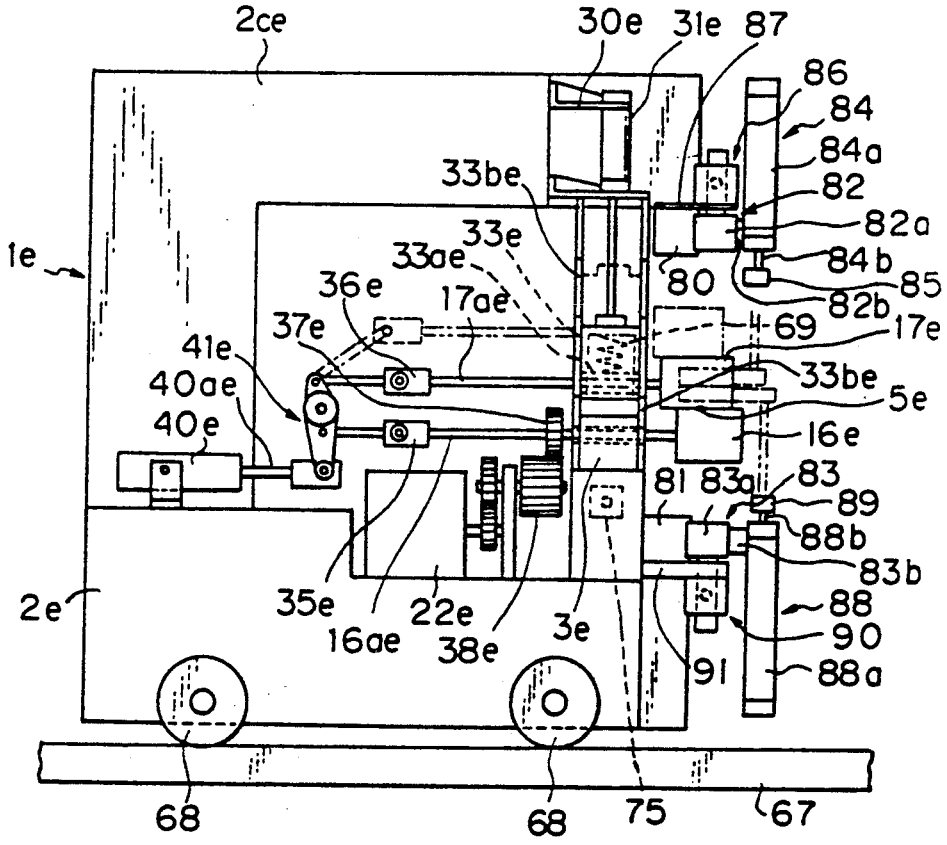
FIG. 7 is a front view of the sliver piecing apparatus shown in FIG. 6.
Figure 8:
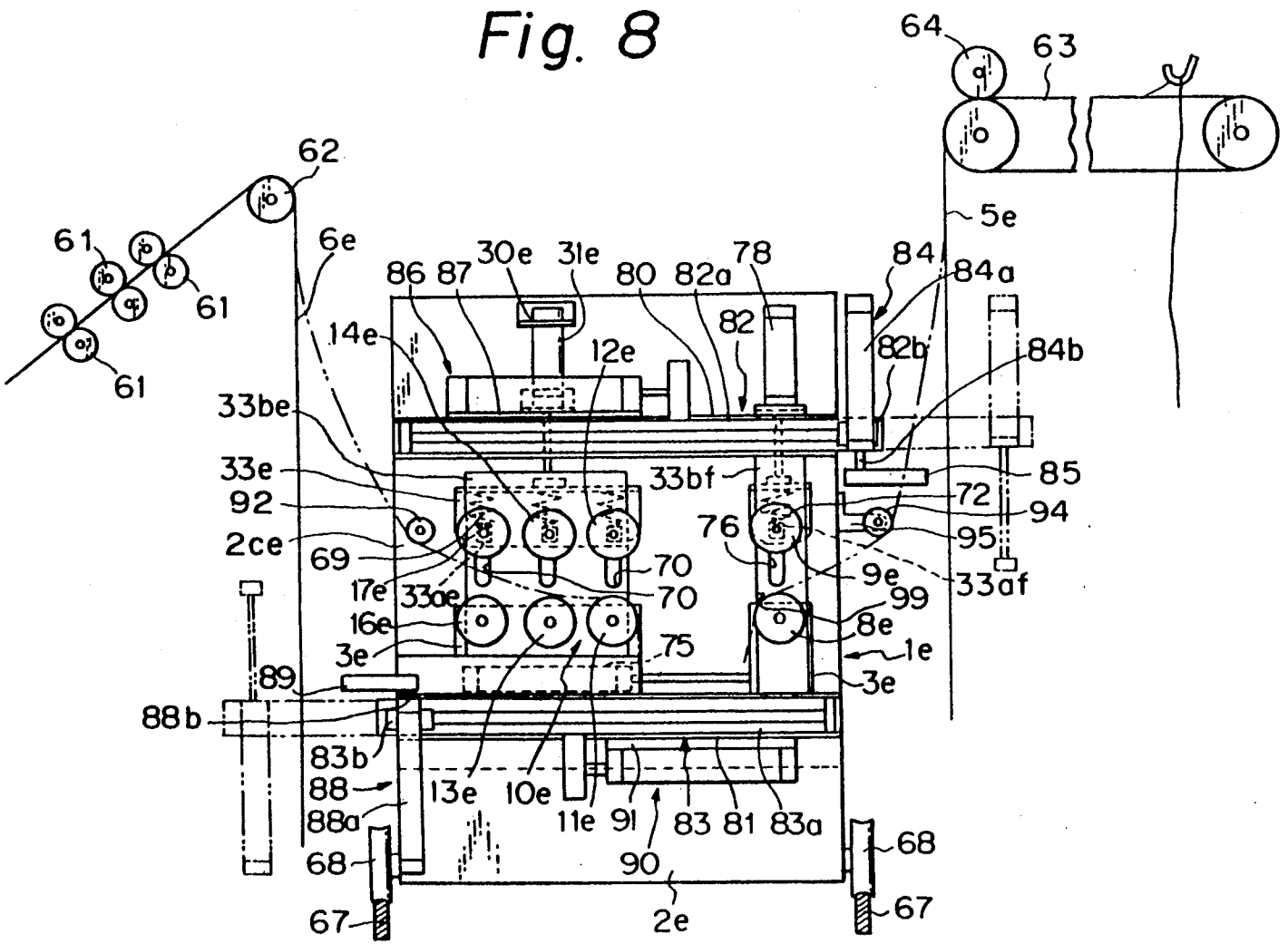
FIG. 8 is a similar view to FIG. 6 but illustrating a sliver piecing operation.

FIGS. 6 through 8 illustrate an embodiment in which an apparatus according to the present invention similar to the embodiment shown in FIGS. 1 through 3 is used for the sliver piecing in a rear side of a roving frame. In the drawings, the same reference numerals are used for designating the same or similar parts referred to in the preceding embodiments, with the addition of a suffix e, and a specific explanation thereof is omitted to avoid redundancy.

In FIG. 6, a series of draft rollers 61 is mounted on a machine frame 60 of a roving frame, and a sliver in a can (not shown) is fed thereto through a creel conveyor 63 and a guide roller 62 while under a pressure from a roller 64 rotatably mounted at an end of the creel conveyor 63. A large space is provided between the guide roller 62 and the creel conveyor 63, and in this space, a pair of rails 67 are arranged on a floor, lengthwise of the machine frame 60, and a sliver piecing apparatus 1*er*ested thereon by castors 68 secured to a base frame 2*e* of the apparatus. At least one of these castors 68 is driven in the normal/reverse direction by a not shown motor.

An upper back roller 12*e*, an upper front roller 14*e* and an upper rubbing roller 17*e* are rotatably supported by bearings 33*ae* and mounted on a first top arm member 33*e* while biased downward by the respective springs 69. The first top arm member 33*e* is slidably fitted between a pair of guide plates 33*be* fixed on the opposite sides of a first roller stand 3*e* and is displaceable up and down along the guide plates 33*be*. The guide plate 33*be* has vertical slots 70 allowing the up and down movement of shafts of the respective upper rollers 12*e*, 14*e* and 17*e*.

A shaft of a lower feed roller 8*e* is supported on a second roller stand 3*f* displaceable, by a power cylinder 75 mounted on the base frame 2*e*, in the horizontal direction away from and toward back roller 11*e* on the base frame 2*e*. A shaft of an upper feed roller 9*e* is supported by a bearing 33*af* on a second top arm member 33*f* while biased downward by a spring 72.

The second top arm member 33*f* is slidably fitted between a pair of guide plates 33*bf* fixed on the opposite sides of the second roller stand 3*f* and is displaceable up and down along the guide plates 33*bf*. The guide plate 33*bf* has vertical slots 76 allowing the up and down movement of a shaft of the upper feed roller 9*e*.

Upper and lower guide rails 80, 81 are arranged in front of the base frame 2*e*, which respectively carry bodies 82*a*, 83*a* of rodless cylinders 82, 83 which are lengthwise displaceable. A body 84*a* of a rotary type power cylinder 84 is fixedly secured, while directed downward, on a mount 82*b* of the upper rodless cylinder 82. A piston rod 84*b* has an actuating piece 85 at a tip end thereof. A power cylinder 86 is secured to a bracket 87 fixed on the guide rail 80, for a lengthwise displacing of the body 82*a* of the upper rodless cylinder 82. A body 88*a* of a rotary type power cylinder 88 is fixedly secured, while directed upward, on a mount 83*b* of the lower rodless cylinder 83. A piston rod 88*b* of the rotatory type power cylinder 88 has an actuating piece 89 at a tip end thereof. A power cylinder 90 is secured to a bracket 91 fixed on the guide rail 81, for a lengthwise displacing of the body 83*a* of the upper rodless cylinder 83.

A guide roller 92 is pivoted to a front wall of a support 2*ce* standing upright from the base frame 2*e*, and another guide roller 94 is pivoted to a bracket 95 fixed on a side wall of the support 2*ce*.

A detector 99 such as a photo tube is arranged for detecting a sliver just downstream of the nip zone of the feed rollers 8*e*, 9*e*.

The operation of the above structure is as follows:

When a sliver 6*e* in an operating can positioned in a creel is almost exhausted, the roving frame is temporarily stopped and the sliver 6*e* severed so that a predetermined length of a trailing portion thereof hangs down from the guide roller 62 as shown in FIG. 8. Then the exhausted can is manually or automatically replaced with a fresh full can and a fresh sliver 5*e* is withdrawn therefrom so that a predetermined length of a leading portion thereof hangs down from the end of the creel conveyor 63, as shown in FIG. 8. In this connection, this preparation of the fresh sliver 5*e* can be carried out beforehand while the roving frame is operating, provided that the drive system for the creel conveyor 63 is independent from that of the roving frame. Further, the sliver preparation is preferably carried out simultaneously for a group of cans arranged adjacent to each other and simultaneously exhausted.

The sliver piecing apparatus 1*e* moves along the guide rails 67 and stops at a position corresponding to the endmost sliver in the group of cans requiring a sliver piecing. Then the first and second top arm members 33*e*, 33*f* are lifted to their uppermost positions and the second roller stand 3*f* is moved to an extremity position farthest from the lower back roller 11*e*. In this connection, these operations can be completed beforehand while the sliver piecing apparatus 1*e* is in a waiting position prior to arriving at the operating position.

The body 82*a* of the rodless cylinder 82 is forwarded by the power cylinder 86 to a position depicted by an imaginary line in FIG. 8, at which the rotary type cylinder 84 is actuated to project the piston rod 84*b* downward and then rotate the same to pivot the actuating piece 85 by 90 degrees. Next, the rodless power cylinder 82 is actuated to move the mount 82*b* to the left in FIG. 8, whereby the actuating piece 85 catches the hanging-down fresh sliver 5*e* and introduces the same into a space between the lower and upper feed rollers 8*e*, 9*e*. Thereafter, the mount 82*b* of the rodless cylinder 82 resumes its original position and the power cylinders 84, 86 resume their original positions.

The power cylinder 78 is actuated to lower the second top arm member 33*f* so that the fresh sliver 5*e* is nipped between the lower and upper feed rollers 8*e* and 9*e*. Thereafter, the lower feed roller 8*e* is reversely rotated to transport the fresh sliver 5*e* backward until the leading end of the fresh sliver is detected by the detector 99.

The power cylinder 90 is actuated to forward the body 83*a* of the lower rodless power cylinder 83 to a position depicted by an imaginary line in FIG. 8, and the power cylinder 88 is actuated to project the piston rod 88*b* upward and then rotate the same to pivot the actuating piece 89 by 90 degrees. Then the rodless power cylinder 83 is actuated to move the mount 83*b* to the right in FIG. 8, whereby the actuating piece 89 catches the hanging-down old sliver 6*e* and introduces the same into a space between the lower rollers 16*e*, 13*e* and 11*e* and the upper rollers 17*e*, 14*e* and 12*e*. Thereafter, the mount 83*b* of the rodless cylinder 83 resumes its original position and the power cylinders 88, 90 resume their original positions.

The power cylinder 31*e* is actuated to lower the first top arm member 33*e* so that the old sliver 6*e* is nipped between the lower rollers 16*e*, 13*e* and 11*e* and the upper rollers 17*e*, 14*e* and 12*e*. At this stage, a predetermined length of the trailing portion of the old sliver 6*e* hangs down from the nip zone between the lower and upper back rollers 11*e* , 12*e*.

Then the power cylinder 75 is actuated to move the second roller stand 3*f* to an extremity position nearest to the back roller 11*e* as shown in FIG. 6. Thus, the first half of the sliver piecing operation is completed, and the second half thereof is carried out in a manner similar to that of the basic embodiment shown in FIGS. 1 through 4. After the completion of the piecing operation for the first set of slivers 5*a*, 6*e*, the first and second top arm members 33*e*, 33*f* are lifted to release the pieced sliver from the nip by rollers, and the sliver piecing apparatus 1*e* is displaced to a position corresponding to the next and adjacent sliver requiring piecing, whereby the pieced sliver is removed from the space between the lower and upper rollers and hangs between the guide roller 62 and the creel conveyor 63 in a catenary state. After the piecing operations of all the slivers in the group is completed, the roving frame restarts the spinning operation. As the speed of a taker-in roller provided on the roving frame is set to be higher than that of a creel conveyor, the catenary of the pieced sliver is gradually eliminated in an earlier stage of the restarting.

According to the above embodiment, the rotary type cylinder 84 and the other means for introducing the second sliver above the lower feed roller 8*e* is arranged above the group of rollers, but they may be positioned beneath the group of rollers as in the case of the rotary type cylinder 88 for the first sliver.

Further, functions of the rodless cylinders 82, 83 may be replaced by a combination of a motor and rack/pinion mechanism.

The second roller stand may be horizontally displaced by a rodless cylinder while fixed on a mount thereof.

As stated above, according to the present invention, the overlapped portion of the old and fresh slivers is first drafted, to improve the parallelism of fibers therein, and next the parallelized fibers are laterally rubbed by the rubbing rollers, whereby the fibers are firmly entangled with each other to form a connection with a uniform thickness and a sufficient mechanical strength able to withstand a force imposed during the subsequent spinning processes. Particularly, according to the present invention, as the overlapped portion can be drafted at a desired ratio, the length thereof is not limited by a mean fiber length but can be elongated to a desired extent, so that a required strength of the connection is obtained.

We claim:

1. A method of piecing first and second slivers, comprising steps of:

overlapping a trailing portion of a first sliver and a leading portion of a second sliver;

introducing the overlapped portion into a drafting zone provided between a pair of upper and lower back rollers and a pair of upper and lower front rollers arranged along a sliver path from upstream to downstream;

maintaining peripheral speeds of the back and front rollers at a same speed so that no draft is imparted to the overlapped portion until a leading end of the overlapped portion has reached the nip zone of the front rollers;

thereafter, changing the relative peripheral speed between the back and front rollers to impart a predetermined draft to the overlapped portion until a trailing end thereof has passed through a nip zone of the back rollers, whereby a thickness of the overlapped portion becomes substantially equal to the original proper sliver thickness;

laterally rubbing the drafted overlapped portion sequentially delivered downstream from the draft zone so that fibers therein are entangled with each other to form a connection with a sufficient mechanical strength able to withstand a force imposed during subsequent spinning processes.

2. A method as defined by claim 1, wherein said rubbing step is carried out by sequentially introducing the drafted overlapped portion into a nip zone of upper and lower rubbing rollers arranged downstream of the front rollers, said upper and lower rubbing rollers being axially reciprocated in the opposite directions while nipping the sliver therebetween.

3. A method as defined by claim 1, wherein said rubbing step is carried out by axially reciprocating the upper and lower front rollers in opposite directions while nipping the sliver therebetween.

4. A method as defined by claim 1, wherein, prior to overlapping the trailing portion of the first sliver with the leading portion of the second sliver, the trailing end of the first sliver is drafted at a predetermined ratio while nipped by the pair of lower and upper back rollers and the pair of lower and upper front rollers.

5. A method as defined by claim 4, the draft ratio of the trailing portion of the first sliver imparted prior to overlapping the trailing portion of the first sliver with the leading portion of the second sliver is substantially 1.6, and the draft ratio of the overlapped portion succeeding thereto is also substantially 1.6, so that the overlapped portion has a thickness equal to that of the original sliver after drafted.

6. An apparatus for piecing first and second slivers, comprising:

a roller stand stationarily mounted on a machine frame;

a group of a lower feed roller, a lower back roller, a lower front roller and a lower rubbing roller, each arranged on the roller stand from upstream to downstream of a sliver path;

a top arm member movable up and down and arranged above the roller stand;

a group of an upper feed roller, an upper back roller, an upper front roller and an upper rubbing roller, each arranged on the top arm member from upstream to downstream of the sliver path; said upper rollers being brought into contact with the corresponding lower rollers on the roller stand and driven thereby when the top arm member is lowered;

a common main motor for driving the lower back and front rollers and the lower rubbing roller;

a sub-motor for exclusively driving the lower feed roller;

means for changing a draft ratio between the lower back and front rollers;

means for axially reciprocating the lower and upper rubbing rollers in opposite direction so that slivers nipped by the lower and upper rubbing rollers are rubbed together; and a controller for controlling the operations of the respective elements constituting the apparatus;

whereby a trailing portion of the first sliver and a leading portion of the second sliver are overlapped with each other while being nipped between the lower rollers and the upper rollers and the overlapped portion is drafted and then rubbed together to form a uniform and reinforced connection therebetween.

7. An apparatus for piecing first and second slivers, comprising:

a first roller stand stationarily mounted on a machine frame;

a group of a lower back roller, a lower front roller and a lower rubbing roller, each arranged on the first roller stand from upstream to downstream of a sliver path;

a first top arm member movable up and down and arranged above the roller stand;

a group of an upper back roller, an upper front roller and an upper rubbing roller, each arranged on the top arm member from upstream to downstream of the sliver path; said upper rollers being brought into contact with the corresponding lower rollers on the first roller stand and driven thereby when the first top arm member is lowered;

a common main motor for driving the lower back and front rollers and the lower rubbing roller;

a second roller stand arranged upstream of the first roller stand, and horizontally displaceable away from and toward the first roller stand;

a lower feed roller arranged on the second roller stand;

a second top arm member movable up and down direction and arranged above the second roller stand, and horizontally displaceable away from and toward the first roller stand;

an upper feed roller arranged on the second top arm member and brought into contact with the lower feed roller and driven thereby when the second top arm member is lowered;

means for horizontally displacing the second roller stand away from and toward the first roller stand;

a sub-motor for exclusively driving the lower feed roller in the normal/reverse direction, and movable together with the second roller stand by the means for displacing the second roller stand;

means for changing a draft ratio between the lower back and front rollers;

means for axially reciprocating the lower and upper rubbing rollers in opposite directions so that slivers nipped by the lower and upper rubbing rollers are rubbed together; and means for introducing a trailing portion of the first sliver above the lower rollers supported on the first roller stand while the first top arm member is lifted;

means for introducing a leading portion of the second sliver above the lower feed roller supported on the second roller stand while the second top arm member is lifted;

means for detecting a leading end of the second sliver in the nip zone of the feed rollers and generating a signal for changing a rotational direction of the sub-motor;

a controller for controlling the operations of the respective elements constituting the apparatus;

whereby a trailing portion of the first sliver and a leading portion of the second sliver are overlapped with each other while nipped between the lower rollers and the upper rollers and the overlapped portion is drafted and then rubbed together to form a uniform and reinforced connection therebetween.

8. A roving frame provided with an apparatus defined by claim 7, which apparatus is arranged in a space between a machine frame of the roving frame and a creel conveyor while movable lengthwise of the machine frame.

* * * * *